US009291995B2

(12) United States Patent
Ueno

(10) Patent No.: US 9,291,995 B2
(45) Date of Patent: Mar. 22, 2016

(54) IMAGE FORMING APPARATUS FOR COOLING A SURFACE OF A RECORDING MEDIUM

(71) Applicant: FUJI XEROX CO., LTD., Tokyo (JP)

(72) Inventor: Hirofumi Ueno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 211 days.

(21) Appl. No.: 13/920,589

(22) Filed: Jun. 18, 2013

(65) Prior Publication Data

US 2014/0126925 A1 May 8, 2014

(30) Foreign Application Priority Data

Nov. 7, 2012 (JP) ..... 2012-245372

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 2221/1645
USPC ..... 399/92
See application file for complete search history.

(56) References Cited

U.S. PATENT DOCUMENTS

2007/0196152 A1* 8/2007 Shimizu et al. ..... 399/405

FOREIGN PATENT DOCUMENTS

| | | |
|---|---|---|
| JP | 2006-256707 A | 9/2006 |
| JP | 2009-288742 | 12/2009 |
| JP | 2010-134332 | 6/2010 |

OTHER PUBLICATIONS

Japanese Office Action (Notification of Reasons for Refusal) issued Dec. 15, 2015, in Japanese application 2012-245372.

* cited by examiner

*Primary Examiner* — David Gray
*Assistant Examiner* — Andrew V Do
(74) *Attorney, Agent, or Firm* — Sughrue Mion, PLLC

(57) ABSTRACT

An image forming apparatus includes a housing; an image forming section that is provided within the housing and forms an image onto a recording medium; an output section that outputs the recording medium, having the image formed thereon by the image forming section, outward from the housing; a loading section on which the recording medium output from the output section is loaded and that is provided with an air hole; and a cooling unit that allows air to flow between an interior of the housing and the loading section via the air hole so as to cool a surface, which faces the loading section, of the recording medium loaded on the loading section.

3 Claims, 7 Drawing Sheets

IMAGE FORMING APPARATUS FOR COOLING A SURFACE OF A RECORDING MEDIUM

CROSS-REFERENCE TO RELATED APPLICATIONS

This application is based on and claims priority under 35 USC 119 from Japanese Patent Application No. 2012-245372 filed Nov. 7, 2012.

BACKGROUND

Technical Field

The present invention relates to image forming apparatuses.

SUMMARY

According to an aspect of the invention, there is provided an image forming apparatus including a housing; an image forming section that is provided within the housing and forms an image onto a recording medium; an output section that outputs the recording medium, having the image formed thereon by the image forming section, outward from the housing; a loading section on which the recording medium output from the output section is loaded and that is provided with an air hole; and a cooling unit that allows air to flow between an interior of the housing and the loading section via the air hole so as to cool a surface, which faces the loading section, of the recording medium loaded on the loading section.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

Figure 1:
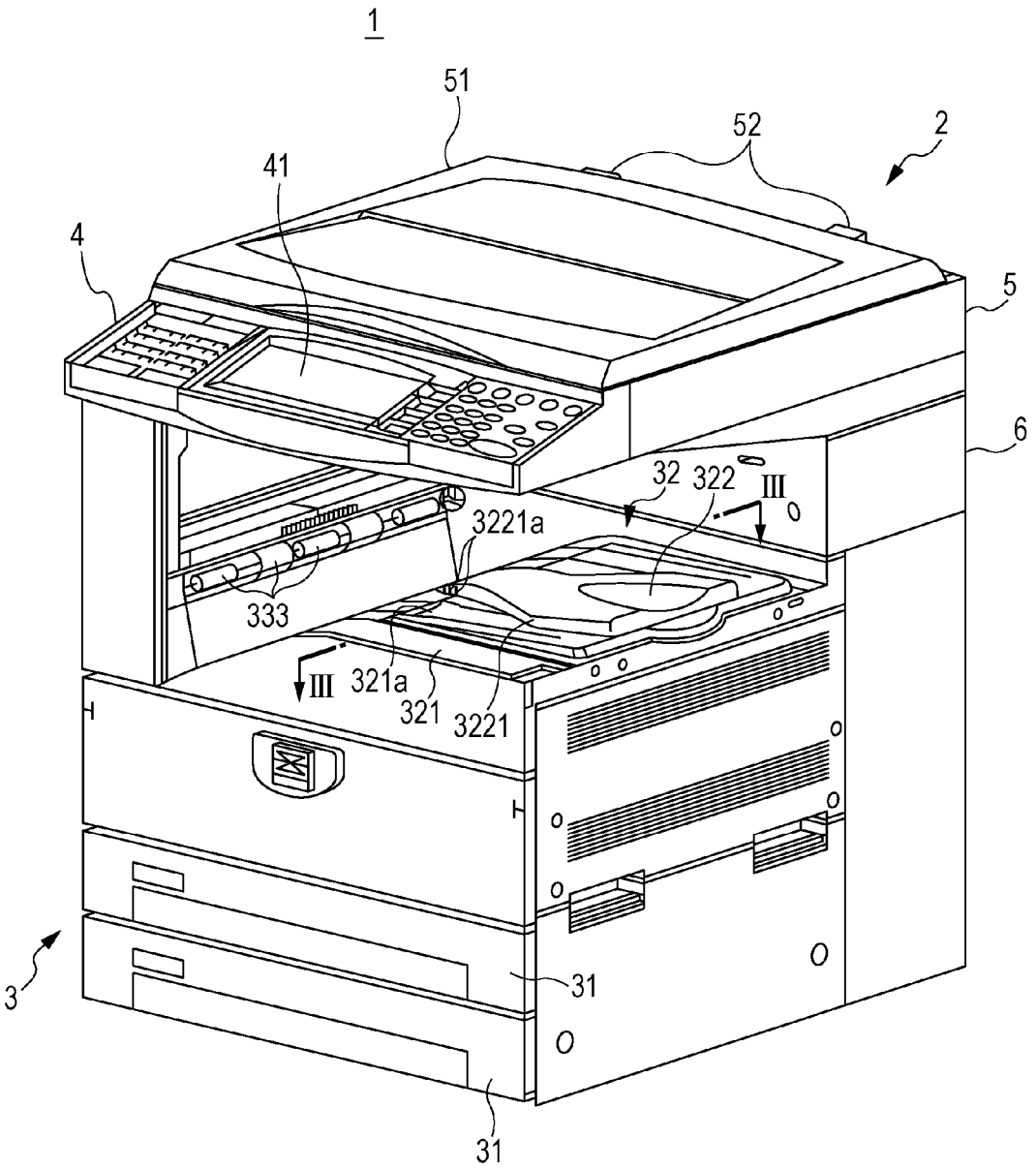
FIG. 1 is an external view of an image forming apparatus according to a first exemplary embodiment of the present invention.

FIG. 1 is an external view of an image forming apparatus according to a first exemplary embodiment of the present invention.

An image forming apparatus 1 shown in FIG. 1 is a digital multifunction apparatus having a printing function, a scanning function, and a photocopying function. The image forming apparatus 1 includes an image reader 2 that reads a document image, an image forming unit 3 that forms an image onto a sheet, and an operable section 4.

The image reader 2 includes an image reading unit 5 and a supporter 6 that supports the image reading unit 5. The image reading unit 5 is attached above the image forming unit 3 via the supporter 6.

The operable section 4 is to be operated by an operator for inputting a copy start command or information related to the number of copies, and is attached to an edge of the image reading unit 5. The operable section 4 includes a display screen 41 that displays setting contents and operation contents.

A cover 51 is provided at an upper portion of the image reading unit 5. The cover 51 is rotatably attached to a rear edge of the image reading unit 5 via a hinge 52 so that the cover 51 is openable and closable relative to the image reading unit 5. Platen glass 53 (see FIG. 2) serving as a read surface on which a document sheet is placed is provided under the cover 51.

The image forming unit 3 is configured to form an image onto a sheet and achieves a copying function by forming an image corresponding to a document image read by the image reading unit 5 onto a sheet. Sheet trays 31 that accommodate sheets onto which images are to be formed are provided at a lower portion of the image forming unit 3. An output tray 32 onto which a sheet having an image formed thereon and output by a pair of output rollers 333 is loaded is provided at an upper portion of the image forming unit 3. The image forming unit 3 forms an image onto a sheet accommodated in one of the sheet trays 31 by electrophotography and outputs the sheet onto the output tray 32. This will be described in detail later. The image forming unit 3 corresponds to an example of an image forming section according to an exemplary embodiment of the present invention. The image reading unit 5 is disposed above the image forming unit 3 with a gap therebetween through which a sheet loaded on the output tray 32 is retrievable by an operator.

In the image forming apparatus 1 having the above-described configuration, for example, when an operator opens the cover 51 at the upper portion of the image reading unit 5, places a document sheet on the platen glass 53 (see FIG. 2), and inputs copy start information by operating the operable section 4, the image reading unit 5 reads a document image from the document sheet placed on the platen glass 53 (see FIG. 2), and the image forming unit 3 forms an image corresponding to the document image read by the image reading unit 5 onto a sheet accommodated in one of the sheet trays 31. Then, the sheet having the image formed thereon is loaded onto the output tray 32.

Figure 2:
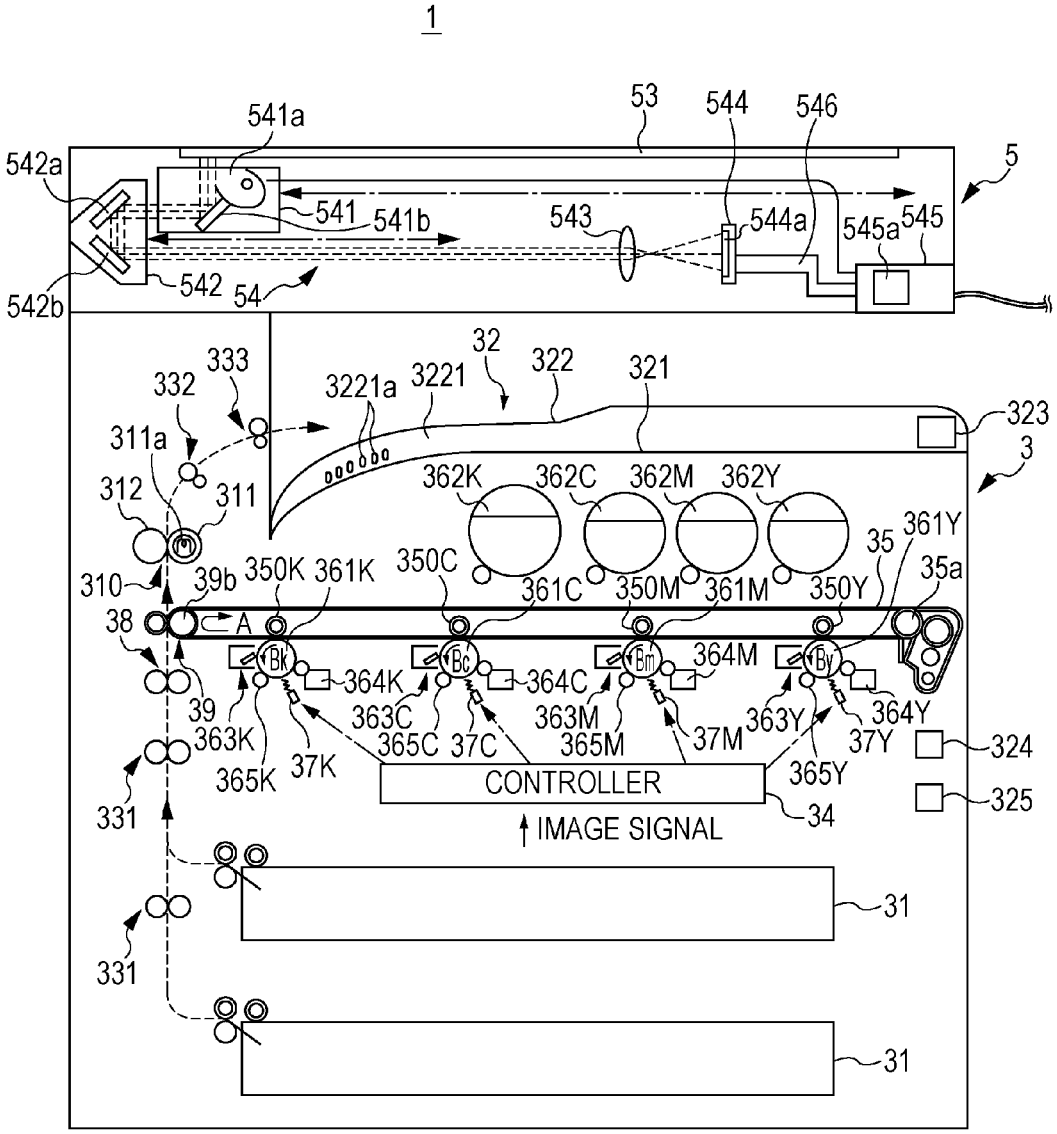
FIG. 2 schematically illustrates the configuration of the image forming apparatus shown in FIG. 1.

FIG. 2 schematically illustrates the configuration of the image forming apparatus 1 shown in FIG. 1.

First, the schematic configuration of the image reading unit 5 in the image forming apparatus 1 will be described.

In FIG. 2, the schematic configuration inside the image reading unit 5 is shown, as viewed from the front side thereof, in a state where the cover 51 (see FIG. 1) is removed. The image reading unit 5 includes the platen glass 53 on which a document sheet is placed, and an image reading mechanism 54 for reading an image. The image reading mechanism 54 includes a first carriage 541 that moves below the platen glass 53 along the platen glass 53, and a second carriage 542 that moves in accordance with the first carriage 541. The first carriage 541 has a light radiating section 541*a* that radiates light toward the platen glass 53, and a first reflecting mirror 541*b* that reflects light reflected by and returning from the document sheet on the platen glass 53 so as to change the traveling direction of the reflected light. The second carriage 542 has a second reflecting mirror 542*a* that reflects the reflected light reflected by the first reflecting mirror 541*b*, and a third reflecting mirror 542*b* that further reflects the reflected light reflected by the second reflecting mirror 542*a*. The first carriage 541 and the second carriage 542 are movable back and forth in the left-right direction by a stepping motor (not shown). The image reading mechanism 54 further includes a lens 543 that converges the reflected light reflected by the third reflecting mirror 542*b*; a signal output section 544 equipped with a charge coupled device (CCD) 544*a* that receives the converged light, converts the received light into an electrical image signal, and outputs the image signal; and a signal processing section 545 equipped with a processing circuit 545*a* that receives the image signal output from the signal output section 544 and performs image processing on the image signal. Furthermore, a signal transmission path 546 that transmits the image signal from the signal output section 544 to the signal processing section 545 is provided between the signal output section 544 and the signal processing section 545. The image reading mechanism 54 moves the first and second carriages 541 and 542 having the reflecting mirrors 541*b*, 542*a*, and 542*b* attached thereto and scans the document sheet placed on the platen glass 53 in the left-right direction so as to read the document image.

Next, the schematic configuration of the image forming unit 3 in the image forming apparatus 1 will be described.

The image forming unit 3 shown in FIG. 2 is of a full-color tandem type. The image forming unit 3 is capable of forming an image onto a resinous recording medium, such as an overhead projector sheet as a representative example, in addition to an ordinary sheet, that is, a paper recording medium. The following description is directed to a case where a paper recording medium is used as a representative example of a sheet, unless otherwise noted.

The image forming unit 3 includes electrophotographic multilayer image bearing members 361K, 361C, 361M, and 361Y that rotate in directions indicated by an arrow Bk, an arrow Bc, an arrow Bm, and an arrow By, respectively. The image bearing members 361K, 361C, 361M, and 361Y are respectively surrounded by roller-shaped charging members 365K, 365C, 365M, and 365Y, light-emitting-diode print heads (LPHs) 37K, 37C, 37M, and 37Y, and developing devices 364K, 364C, 364M, and 364Y. Specifically, each charging member electrostatically charges the corresponding image bearing member while being in contact with the image bearing member and being rotated by the rotation of the image bearing member. The LPHs 37K, 37C, 37M, and 37Y irradiate the respective electrostatically-charged image bearing members 361K, 361C, 361M, and 361Y with exposure light beams based on image signals, which are emitted by multiple arranged light emitting diodes (LEDs), so as to form black (K), cyan (C), magenta (M), and yellow (Y) electrostatic latent images having potentials different from the ambient potential. Each developing device develops the electrostatic latent image on the corresponding image bearing member by electrostatically adhering an electrostatically-charged toner of the corresponding color thereto so as to form a toner image. The four developing devices 364K, 364C, 364M, and 364Y are supplied with toners of the respective colors from four toner cartridges 362K, 362C, 362M, and 362Y by mechanisms (not shown). Furthermore, the image forming unit 3 also includes an intermediate transfer belt 35 onto which the toner images of the respective colors formed on the image bearing members are transferred (first-transferred) and that transports the first-transfer toner images, cleaning devices 363K, 363C, 363M, and 363Y that remove residual toner from the image bearing members by using cleaning blades, first-transfer rollers 350K, 350C, 350M, and 350Y where the toner images of the respective colors are first-transferred onto the intermediate transfer belt 35, and a pair of second-transfer rollers 39 where the first-transfer toner images on the intermediate transfer belt 35 are second-transferred onto a sheet. The intermediate transfer belt 35 receives a driving force from a driving roller 35*a* and rotates in a direction indicated by an arrow A while being extended between the second-transfer roller 39*b* and the driving roller 35*a*. The image forming unit 3 also includes a fixing device 310 that fixes the second-transfer toner image, which has been transferred on the sheet but not fixed thereon yet, onto the sheet. The fixing device 310 includes a fixing roller 311 having a heating mechanism 311*a*, and a pressing roller 312 that is disposed facing the fixing roller 311 and that applies pressure onto the sheet. Furthermore, the image forming unit 3 includes a controller 34 that controls the components, including the LPHs 37K, 37C, 37M, and 37Y, in the image forming unit 3. An image signal that has been processed by the processing circuit 545*a* of the signal processing section 545 is input to the controller 34. For example, the controller 34 processes the input image signal, converts the image signal into an image signal based on which each LPH for the corresponding color forms an electrostatic latent image corresponding to an image expressed by the image signal, and sends the converted image signal to the LPH so as to make the LPH form the electrostatic latent image. Furthermore, the image forming unit 3 also includes the sheet trays 31 that accommodate sheets onto which images are to be formed, the pair of output rollers 333 that output a sheet having an image formed thereon, and the output tray 32 onto which the sheet output by the pair of output rollers 333 is loaded. The pair of output rollers 333 correspond to an example of an output section according to an exemplary embodiment of the present invention. The output tray 32 corresponds to an example of a loading section according to an exemplary embodiment of the present invention.

Next, an image forming operation performed in the image forming unit 3 will be described.

The four image bearing members 361K, 361C, 361M, and 361Y are electrostatically charged by the charging members 365K, 365C, 365M, and 365Y, respectively, and are irradiated with exposure light beams based on image signals radiated from the LEDs of the LPHs 37K, 37C, 37M, and 37Y, respectively, whereby electrostatic latent images are formed on the image bearing members 361K, 361C, 361M, and 361Y. The developing devices 364K, 364C, 364M, and 364Y develop the formed electrostatic latent images by using developers containing toners of the respective colors, thereby forming toner images of the respective colors. At the first-transfer rollers 350K, 350C, 350M, and 350Y corresponding to the respective colors, the toner images of the respective colors formed in this manner are sequentially transferred (first-transferred) and superposed onto the intermediate transfer belt 35 in the following order: yellow (Y), magenta (M), cyan (C), and black (K). As a result, a multicolor first-transfer toner image is formed. Then, the multicolor first-transfer toner image is transported to the pair of second-transfer rollers 39 by the intermediate transfer belt 35. In concert with the formation of the multicolor first-transfer toner image, a sheet is fed from one of the sheet trays 31 and is transported to a pair of first transport rollers 331, and moreover, the orientation of the sheet is adjusted by a pair of registration rollers 38. Subsequently, the pair of second-transfer rollers 39 transfer (second-transfer) the aforementioned multicolor first-transfer toner image onto the transported sheet. Then, the fixing device 310 fixes the second-transfer toner image onto the sheet. More specifically, the sheet is transported between the fixing roller 311 and the pressing roller 312 that face each other in the fixing device 310. The toners constituting the second-transfer toner image, which is formed on the sheet but not fixed thereon yet, are fused by the heating mechanism 311*a* of the fixing roller 311, whereby a fixed image formed of a fixed toner image is formed on the sheet. In this case, a sheet transport path is indicated by an upward dotted arrow in FIG. 2.

After the second-transfer toner image is fixed onto the sheet by the fixing device 310, the sheet travels through a pair of second transport rollers 332 and the pair of output rollers 333 and is output onto the output tray 32, as indicated by a rightward dotted arrow in FIG. 2.

The above description relates to the image forming operation performed in the image forming unit 3.

Because the sheet output by the pair of output rollers 333 has been heated by the heating mechanism 311*a* when traveling through the fixing device 310, the sheet carries heat. Therefore, when the image forming operation is performed consecutively on multiple sheets, the sheets are loaded onto the output tray 32 in a state where the heat-carrying sheets are closely in contact with each other. This may sometimes result in the occurrence of so-called sheet blocking in which the sheets become attached to each other due to re-fusing of the toner on the sheets caused by the heat.

In view of this, a countermeasure for preventing the occurrence of sheet blocking is provided in the image forming apparatus 1 according to the first exemplary embodiment.

The following description with reference to FIGS. 1 and 2 relates to the countermeasure for preventing the occurrence of sheet blocking.

The output tray 32 provided in the image forming unit 3 of the image forming apparatus 1 has a loading surface 321 provided with a protrusion 322 thereon. The protrusion 322 has protruding side portions 3221 provided with air holes 3221*a*. The loading surface 321 also has recesses 321*a* that are recessed downward at positions where air blown out from the air holes 3221*a* strikes. The protrusion 322 may be attachable to and detachable from the loading surface 321, or may be integrated with the loading surface 321.

Figure 3:
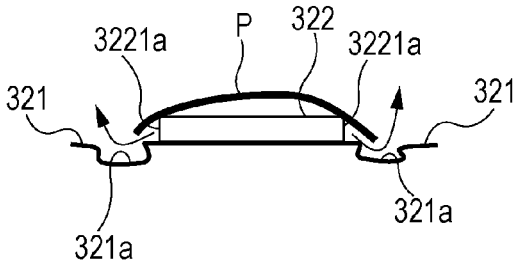
FIG. 3 is a vertical sectional view taken along line III-III in FIG. 1.

FIG. 3 is a vertical sectional view taken along line III-III in FIG. 1.

As shown in FIG. 3, air blown out from the air holes 3221*a* is dispersed by the recesses 321*a* so that the air strikes a wide area of a sheet P loaded on the output tray 32.

Referring back to FIGS. 1 and 2, the description of the countermeasure for preventing the occurrence of sheet blocking will continue below.

The image forming unit 3 is provided with an air blower 323 at the underside of the protrusion 322, which is a dead space. The air blower 323 is constituted of a direct-current (DC) motor and a fan. The fan is rotated by receiving a driving force from the motor and sends air toward the underside of the protrusion 322 so that the air is blown out from the air holes 3221*a*. The air blower 323 is of an airflow adjustable type. The air blower 323 corresponds to an example of a cooling unit according to an exemplary embodiment of the present invention.

Furthermore, the image forming unit 3 includes a temperature sensor 324 that measures the ambient temperature.

The image forming unit 3 also includes a counter 325 that counts the number of sheets output from the pair of output rollers 333.

The controller 34 provided in the image forming unit 3 controls the operation of the air blower 323. More specifically, since sheet blocking tends to occur more frequently as the number of sheets loaded on the output tray 32 increases, the controller 34 actuates the air blower 323 when the number of sheets counted by the counter 325 is 100 or more. Moreover, since sheet blocking tends to occur more frequently as the ambient temperature increases, the controller 34 actuates the air blower 323 when the ambient temperature measured by the temperature sensor 324 is 32° C. or higher. After actuating the air blower 323, the controller 34 increases the amount of air sent from the air blower 323 as the number of sheets counted by the counter 325 increases. Specifically, the controller 34 increases an average voltage supplied to the DC motor so as to rotate the fan at higher speed, thereby increasing the amount of air sent from the air blower 323.

With the image forming apparatus 1 according to the first exemplary embodiment, the sheets output by the pair of output rollers 333 and loaded onto the output tray 32 are cooled by the air blown out from the air holes 3221*a*, whereby the occurrence of sheet blocking may be prevented. Furthermore, in the image forming apparatus 1 according to the first exemplary embodiment, the air blower 323 is actuated when the number of output sheets is 100 or more. Therefore, when the number of output sheets is smaller than 100, a state where the sheets loaded on the output tray 32 are scattered about on the output tray 32 due to air blown out from the air holes 3221*a*, that is, a poorly accommodated state of the sheets loaded on the output tray 32, may reliably be avoided. Furthermore, in the image forming apparatus 1 according to the first exemplary embodiment, the air blower 323 is actuated when the ambient temperature is 32° C. or higher, so that power consumption may be reduced. Moreover, in the image forming apparatus 1 according to the first exemplary embodiment, the amount of air sent from the air blower 323 is increased with increasing number of output sheets, whereby a good accommodated state of the sheets loaded on the output tray 32 may be achieved.

The description of the image forming apparatus 1 according to the first exemplary embodiment of the present invention ends here. The following description relates to an image forming apparatus according to a second exemplary embodiment of the present invention. In the second exemplary embodiment, the countermeasure for preventing the occurrence of sheet blocking is different from that in the first exemplary embodiment described above.

In the following description, elements that are similar to those in the first exemplary embodiments are given the same reference numerals, and redundant descriptions will be omitted. The following description is directed to differences from the first exemplary embodiment.

Figure 4:
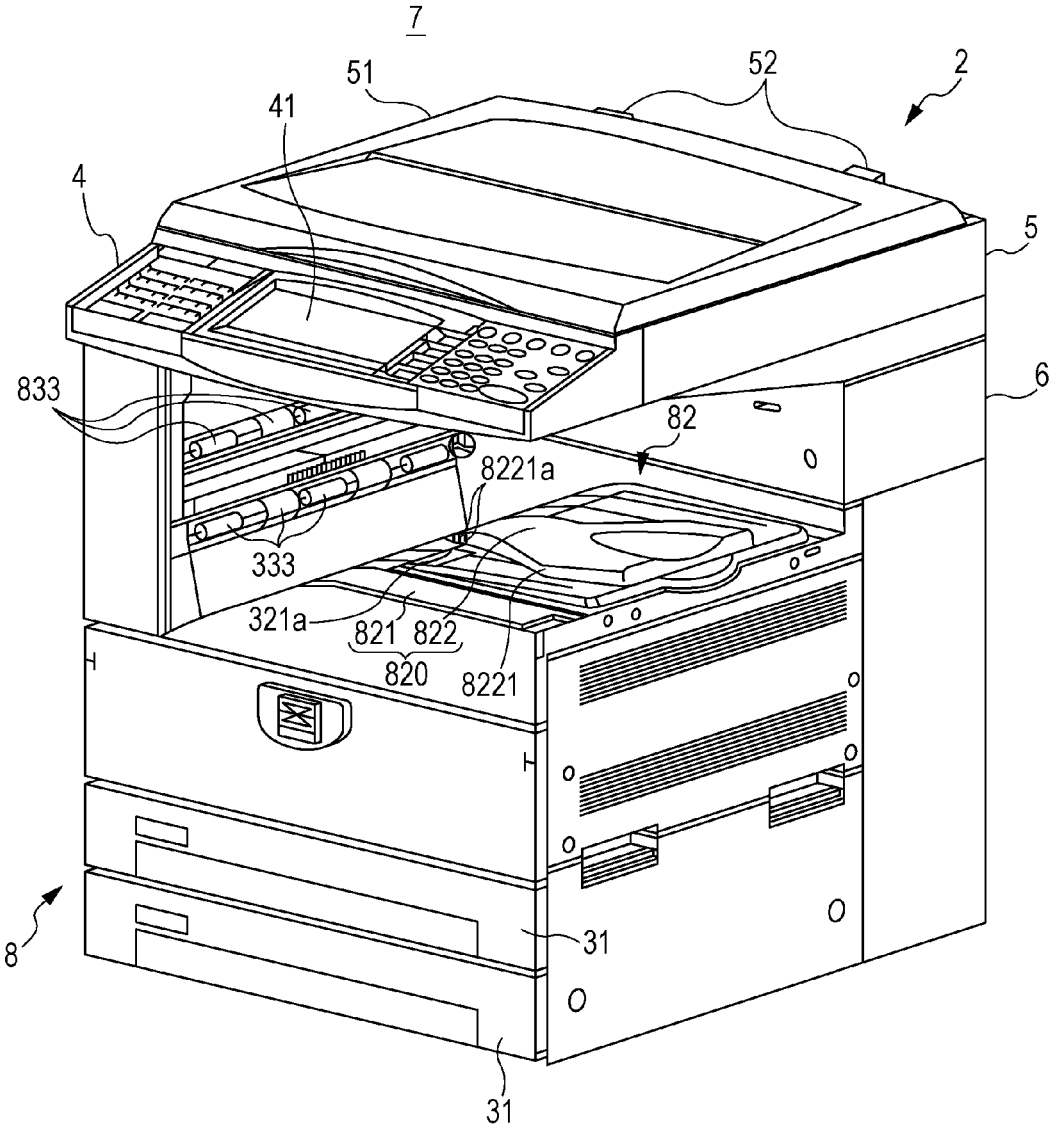
FIG. 4 is an external view of an image forming apparatus according to a second exemplary embodiment of the present invention.
Figure 5:
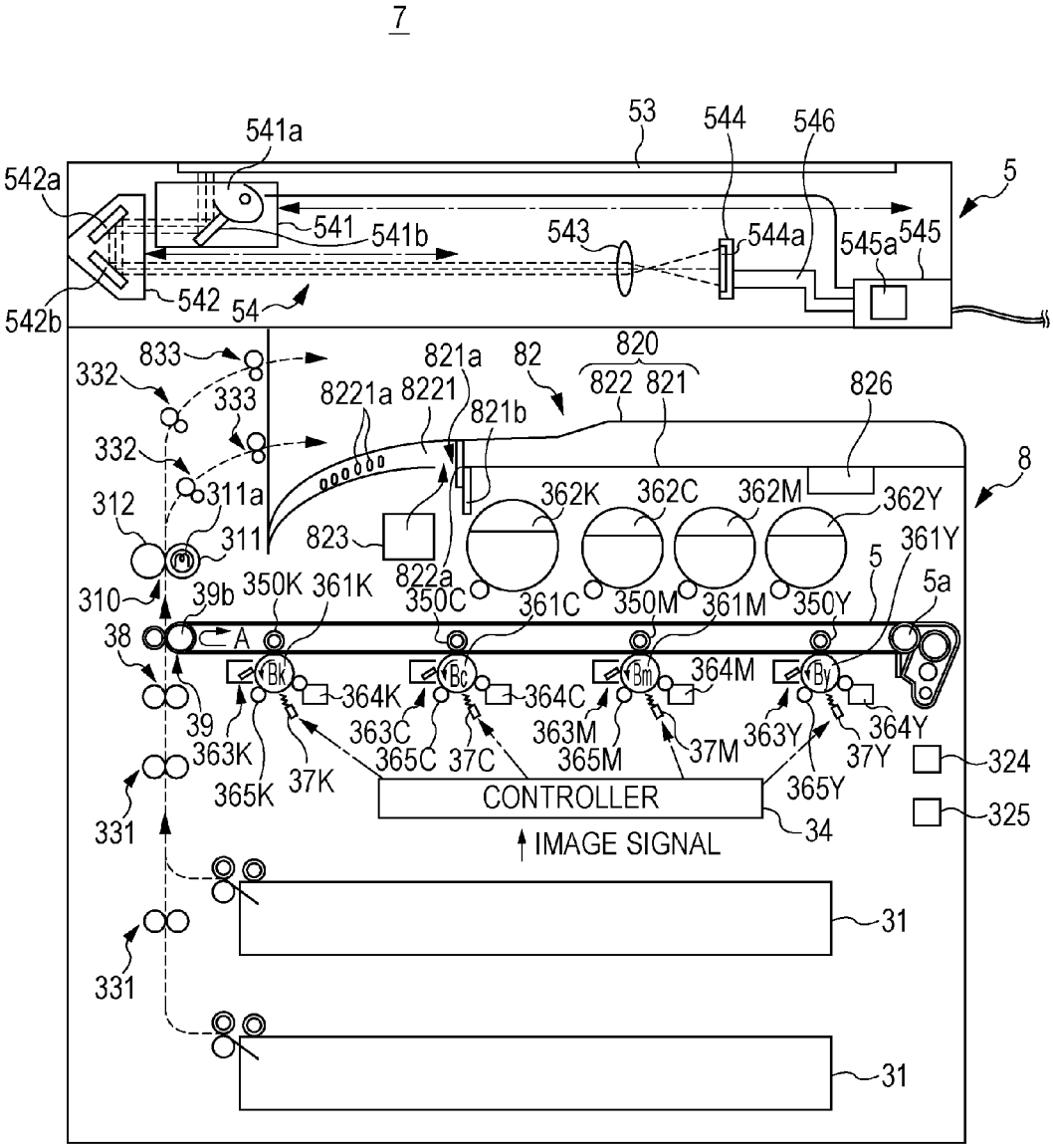
FIG. 5 schematically illustrates the configuration of the image forming apparatus shown in FIG. 4.

FIG. 4 is an external view of the image forming apparatus according to the second exemplary embodiment of the present invention. FIG. 5 schematically illustrates the configuration of the image forming apparatus shown in FIG. 4.

An image forming unit 8 in an image forming apparatus 7 shown in FIGS. 4 and 5 includes an output tray 82 in place of the output tray 32 (see FIGS. 1 and 2) described above. The output tray 82 has a configuration different from that of the output tray 32. More specifically, the output tray 82 has a loading plate 821 and an auxiliary loading member 822 that is disposed on the loading plate 821 and that serves as the protrusion in the first exemplary embodiment. When disposed on the loading plate 821, the auxiliary loading member 822 protrudes upward and is inclined downward with decreasing distance to the pair of output rollers 333. The auxiliary loading member 822 has side portions 8221 provided with air holes 8221*a*. A loading surface 820 is formed by the auxiliary loading member 822 and an area on the upper surface of the loading plate 821 that is located away from the auxiliary loading member 822. The output tray 82 corresponds to an example of a loading section according to an exemplary embodiment of the present invention.

In addition to the pair of output rollers 333 (see FIGS. 1 and 2) described above, the image forming unit 8 includes a pair of second output rollers 833 disposed above the pair of output rollers 333. A combination of the pair of output rollers 333 and the pair of second output rollers 833 corresponds to an example of an output section according to an exemplary embodiment of the present invention.

Figure 6:
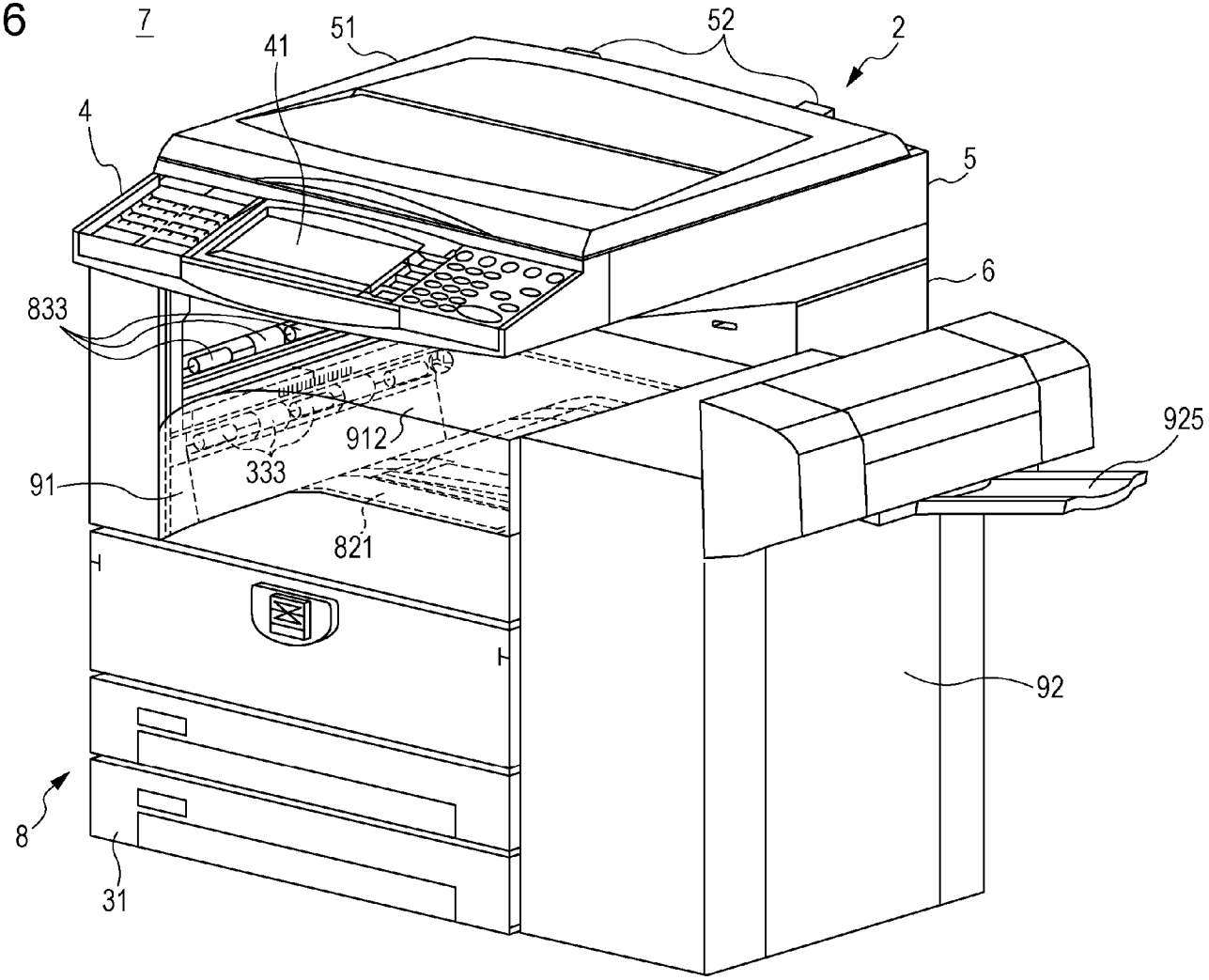
FIG. 6 is an external view of an apparatus including the image forming apparatus shown in FIGS. 4 and 5 equipped with a sheet transport device and a post-processing device connected to the image forming apparatus.
Figure 7:
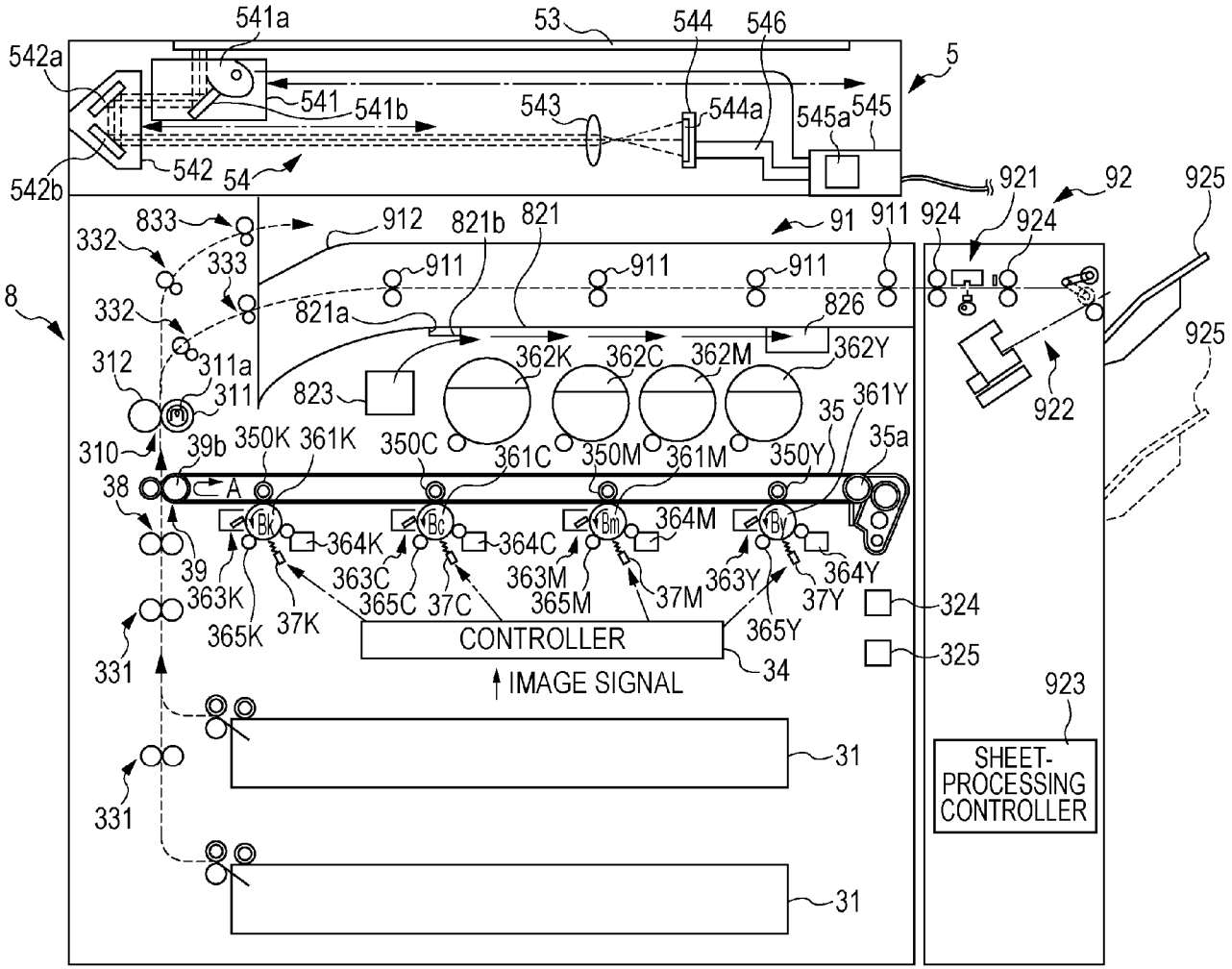
FIG. 7 schematically illustrates the configuration of the apparatus shown in FIG. 6.

FIG. 6 is an external view of an apparatus including the image forming apparatus 7 shown in FIGS. 4 and 5 equipped with a sheet transport device and a post-processing device connected to the image forming apparatus 7. FIG. 7 schematically illustrates the configuration of the apparatus shown in FIG. 6.

As shown in FIGS. 6 and 7, in place of the auxiliary loading member 822 (see FIGS. 4 and 5), a sheet transport device 91 may be installed on the upper surface of the loading plate 821 in the image forming apparatus 7. Specifically, the sheet transport device 91 has pairs of third transport rollers 911 therein by which a sheet output by the pair of output rollers 333 toward the output tray 82 is transported further downstream. Furthermore, the image forming apparatus 7 is connectable to a post-processing device 92 that receives the sheet transported via the sheet transport device 91 and that performs post-processing on the sheet. FIGS. 6 and 7 illustrate a state where the image forming apparatus 7 is equipped with the sheet transport device 91 and is connected to the post-processing device 92. As shown in FIG. 7, the post-processing device 92 includes a puncher 921, a stapler 922, and a sheet-processing controller 923 that controls the operation of the puncher 921 and the stapler 922 and that communicates with the image forming apparatus 7. The sheet entering the post-processing device 92 is transported by pairs of fourth transport rollers 924. When there is a command for forming punched holes along an edge of the sheet, the puncher 921 is actuated. Then, the sheet having the punched holes formed therein is further transported so as to be output onto a sheet tray 925. The sheet tray 925 is movable in the vertical direction between a position indicated by a solid line and a position indicated by a dashed line in FIG. 7, and is sequentially lowered in accordance with the overall thickness of sheets sequentially loaded on the sheet tray 925. When there is a command for binding together a stack of sheets by using the stapler 922 equipped in the post-processing device 92, the stapler 922 is actuated so that a stapling operation is performed. In the apparatus including the image forming apparatus 7 equipped with the sheet transport device 91 and the post-processing device 92 connected to the image forming apparatus 7, if there is no command for performing post-processing in the apparatus, a sheet having an image formed thereon passes through the pair of second output rollers 833 so as to be output onto an upper surface 912 of the sheet transport device 91. The sheet transport device 91 corresponds to an example of a transport device according to an exemplary embodiment of the present invention. The post-processing device 92 corresponds to an example of a post-processing device according to an exemplary embodiment of the present invention.

As shown in FIGS. 5 and 7, the four toner cartridges 362K, 362C, 362M, and 362Y accommodating the toners to be used in the image forming operation by the image forming unit 8 are disposed at the underside of the loading plate 821.

Furthermore, as shown in FIGS. 5 and 7, in place of the air blower 323 (see FIG. 2) described above, the image forming unit 8 includes an air blower 823 that is disposed at the underside of the loading plate 821 between the toner cartridge 362K and the fixing device 310. Moreover, an exhaust fan 826 for exhausting air outside the apparatus is provided at the back side of the toner cartridge 362Y in the traveling direction of the exhaust air.

As described above, because a sheet output by the pair of output rollers 333 has been heated by the heating mechanism 311*a* when traveling through the fixing device 310, the sheet carries heat. When an image forming operation and post-processing are performed in the apparatus including the image forming apparatus 7 equipped with the sheet transport device 91 and the post-processing device 92 connected to the image forming apparatus 7, the heat-carrying sheet is transported through the sheet transport device 91. The sheet transport device 91 is installed on the upper surface of the loading plate 821, and the four toner cartridges 362K, 362C, 362M, and 362Y are disposed at the underside of the loading plate 821. Therefore, when an image forming operation and post-processing are performed consecutively on multiple sheets, the heat carried by the sheets transported through the sheet transport device 91 may be transmitted to the four toner cartridges 362K, 362C, 362M, and 362Y, possibly resulting in a problem where the toners become fixed within the toner cartridges 362K, 362C, 362M, and 362Y. The air blower 823 and the exhaust fan 826 in the image forming unit 8 are provided as a countermeasure for preventing such a problem.

Specifically, as shown in FIGS. 6 and 7, in the state where the sheet transport device 91 is installed in the image forming apparatus 7 and the post-processing device 92 is connected thereto, the air blower 823 cools the four toner cartridges 362K, 362C, 362M, and 362Y by blowing air toward the underside of the loading plate 821.

Figure 8:
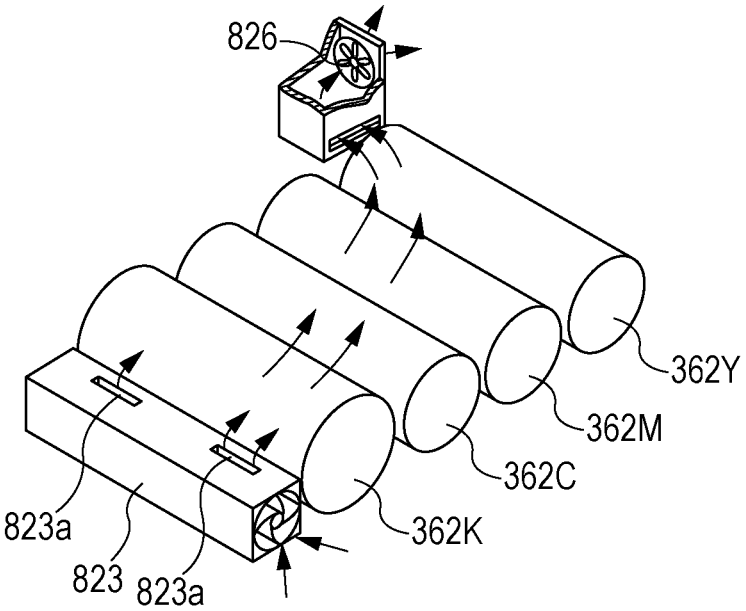
FIG. 8 is a perspective view illustrating the relationships among an air blower, four toner cartridges, and an exhaust fan.

FIG. 8 is a perspective view illustrating the relationships among the air blower 823, the four toner cartridges 362K, 362C, 362M, and 362Y, and the exhaust fan 826.

As shown in FIG. 8, a side surface located at the upper side of the air blower 823 is provided with rectangular air outlets 823*a* that are spaced apart from each other in the lengthwise direction of the air blower 823. As indicated by arrows in FIG. 8, air flowing out from the air outlets 823*a* of the air blower 823 forms an air flow path extending diagonally above the four toner cartridges 362K, 362C, 362M, and 362Y and is discharged outside the apparatus by the exhaust fan 826. Therefore, in the image forming apparatus 7, fixation of the toners within the toner cartridges 362K, 362C, 362M, and 362Y occurring due to heat-carrying sheets being transported through the sheet transport device 91 may be prevented.

Referring back to FIGS. 4 to 7, the description of the image forming unit 8 in the image forming apparatus 7 will continue below.

As shown in FIGS. 5 and 7, the loading plate 821 has an opening 821*a* extending therethrough from the top surface to the undersurface thereof, and a lid 821*b* that blocks the opening 821*a* at the underside thereof and is opened by being pressed from above. For example, the lid 821*b* is biased in the closing direction by a spring (not shown) and is opened against the bias force when the lid 821*b* receives a downward pressing force from a claw member 822*a*, to be described below.

Figure 9:
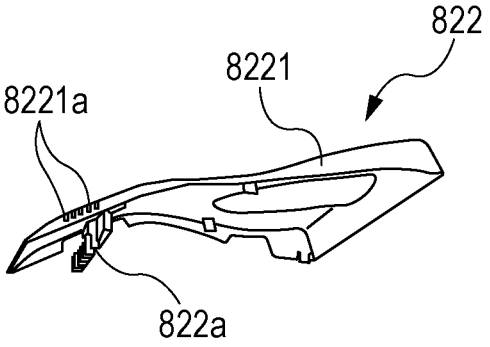
FIG. 9 is a perspective view of an auxiliary loading member, as viewed at an angle from below.

FIG. 9 is a perspective view of the auxiliary loading member 822, as viewed at an angle from below.

As shown in FIGS. 5 and 9, the auxiliary loading member 822 has the claw member 822*a* that protrudes toward the underside of the loading plate 821 by pressing the lid 821*b* when the auxiliary loading member 822 is installed on the loading plate 821.

As shown in FIG. 5, when the auxiliary loading member 822 is installed on the loading plate 821, the claw member 822*a* protrudes toward the underside of the loading plate 821. Thus, air from the air blower 823 is guided to an area between the loading plate 821 and the auxiliary loading member 822 by the claw member 822*a*. As a result, the air is blown out from the air holes 8221*a* formed in the side portions 8221 of the auxiliary loading member 822. In other words, when the auxiliary loading member 822 is installed on the loading plate 821, the air blower 823 cools a sheet output by the pair of output rollers 333 and loaded onto the output tray 82. Consequently, the occurrence of sheet blocking may be prevented. The air blower 823 corresponds to an example of a cooling unit according to an exemplary embodiment of the present invention. The claw member 822*a* itself may serve as the component that changes the air flowing direction so as to guide the air from the air blower 823 to the area between the loading plate 821 and the auxiliary loading member 822. As another alternative, the lid 821*b* that receives a downward pressing force from the claw member 822*a* may serve as the component that changes the air flowing direction so as to guide the air from the air blower 823 to the area between the loading plate 821 and the auxiliary loading member 822.

For preventing the occurrence of sheet blocking, a dedicated air blower for blowing air out from the air holes 8221*a* is not necessary in the image forming apparatus 7 according to the second exemplary embodiment.

The description of the image forming apparatus 7 according to the second exemplary embodiment of the present invention ends here.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

an image forming section that is provided within the housing and that is configured to form an image onto a recording medium;

an output section configured to output the recording medium, having the image formed thereon by the image forming section, outward from the housing;

a loading section configured such that the recording medium output from the output section is loaded on the loading section, wherein the loading section comprises an air hole; and a cooling unit configured to allow air to flow between an interior of the housing and the loading section via the air hole so as to cool a surface, which faces the loading section, of the recording medium loaded on the loading section, wherein the loading section includes a reference surface and a protrusion that protrudes from the reference surface and that has a receiving surface configured to receive the output recording medium, wherein the air hole is provided in a surface of the protrusion that is different from the receiving surface, wherein the image forming apparatus is configured such that the output recording medium is loaded in a state where a portion of the output recording medium protrudes from the receiving surface so that a surface, which faces the loading section, of the protruding portion is cooled, wherein the loading section further has a recess that is provided at a side of the protrusion and that is recessed from the reference surface, and wherein a cooling flow path is ensured by positioning an edge of the recording medium loaded on the loading section within the recess so that the air flowing via the air hole travels between the edge of the recording medium and the recess.

2. The image forming apparatus according to claim 1, wherein the cooling unit is provided at an underside of the loading section.

3. An image forming apparatus comprising;

a housing;

an image forming section that is provided within the housing and that is configured to form an image onto a recording medium;

an output section configured to output the recording medium, having the image formed thereon by the image forming section, outward from the housing;

a loading section configured such that the recording medium output from the output section is loaded on the loading section, wherein the loading section comprises an air hole; and a cooling unit configured to allow air to flow between an interior of the housing and the loading section via the air hole so as to cool a surface, which faces the loading section of the recording medium loaded on the loading section, wherein the loading section has a loading plate and an auxiliary loading member that at least includes the air hole and that is attachable to and detachable from the loading plate, wherein a loading surface of the loading section is formed by the auxiliary loading member and an area on an upper surface of the loading plate that is located away from the auxiliary loading member, wherein if the image forming apparatus is configured to be connected to a post-processing device that performs post-processing on the recording medium having the image formed thereon by the image forming section, a transport device that transports the recording medium output from the output section toward the post-processing device is connected to the loading plate, wherein if the image forming apparatus is not connected to the post-processing device, the auxiliary loading member is connected to the loading plate, wherein if the transport device is connected to the loading plate, the cooling unit cools the interior of the housing, and wherein if the auxiliary loading member is connected to the loading plate, the cooling unit allows the air to flow via the air hole provided in the auxiliary loading member so as to cool the surface, which faces the loading section, of the recording medium loaded on the loading section.

* * * * *